US006571452B1

(12) United States Patent
Wang

(10) Patent No.: US 6,571,452 B1
(45) Date of Patent: Jun. 3, 2003

(54) METHOD OF MAKING STEEL COUPLERS FOR JOINING CONCRETE REINFORCING BARS

(75) Inventor: Tien Fa Wang, Chung Ho (TW)

(73) Assignee: Barsplice Products, Inc., Beavercreek, OH (US)

( * ) Notice: Subject to any disclaimer, the term of this patent is extended or adjusted under 35 U.S.C. 154(b) by 0 days.

(21) Appl. No.: 09/718,209

(22) Filed: Nov. 21, 2000

Related U.S. Application Data

(63) Continuation of application No. 09/233,399, filed on Jan. 19, 1999, now abandoned.

(51) Int. Cl.[7] ..... B23P 13/04
(52) U.S. Cl. ..... 29/557; 72/356; 72/345
(58) Field of Search ..... 72/334, 345, 356; 403/300; 29/557

(56) References Cited

U.S. PATENT DOCUMENTS

| | | | | |
|---|---|---|---|---|
| 172,253 | A | | 1/1876 | Chapman |
| 2,789,344 | A | | 4/1957 | Karl |
| 3,056,197 | A | | 10/1962 | Lawson |
| 3,079,682 | A | | 3/1963 | Bailey |
| 3,101,534 | A | * | 8/1963 | Longe |
| 3,186,209 | A | | 6/1965 | Friedman |
| 3,415,552 | A | | 12/1968 | Howlett |
| 3,551,999 | A | | 1/1971 | Gutmann |
| 3,638,978 | A | * | 2/1972 | Guntermann |
| 4,166,373 | A | * | 9/1979 | Braun |
| 4,416,141 | A | * | 11/1983 | Nippert |
| 4,423,616 | A | | 1/1984 | Pease |
| 4,752,151 | A | * | 6/1988 | Ashida |
| 4,918,969 | A | * | 4/1990 | Takeuchi et al. |
| 5,088,311 | A | | 2/1992 | Inoue |
| 5,152,118 | A | * | 10/1992 | Lancelot |
| 5,399,274 | A | | 3/1995 | Marcus |
| 5,664,902 | A | | 9/1997 | Holdsworth |
| 5,689,882 | A | | 11/1997 | Adachi et al. |
| 5,729,952 | A | * | 3/1998 | Dahl |
| 5,871,403 | A | * | 2/1999 | Simmons et al. |

* cited by examiner

*Primary Examiner*—Douglas Olms
*Assistant Examiner*—Steve Blount
(74) *Attorney, Agent, or Firm*—Jacox, Mechstroth & Jenkins

(57) ABSTRACT

A section of heat treated solid steel rod receives a phosphate solution treatment and is inserted into a blind cavity of a first die member within a cold forging press. A punch is forced axially into the rod section in successive steps to cold-forge a first bore and a tubular first end portion of a coupler body. A second end portion of the coupler body is also cold-forged in successive steps after treatments and is either reduced in diameter to receive external threads or is formed with a second bore. Each of the first and second bores receives an end portion of a concrete reinforcing bar after which the tubular end portion of body is compressed or swaged inwardly to secure the body to the reinforcing bar. The second bore may also be machined with internal threads for receiving the external threads on another coupler.

2 Claims, 2 Drawing Sheets

METHOD OF MAKING STEEL COUPLERS FOR JOINING CONCRETE REINFORCING BARS

This is a continuation of application Ser. No. 09/233,399, filed Jan. 19, 1999, now abandoned.

BACKGROUND OF THE INVENTION

In the production of tubular steel couplers for joining opposing end portions of two concrete reinforcing rods, commonly referred to as "rebars", for example, of the general type disclosed in U.S. Pat. Nos. 3,415,552, 3,551,999 and also U.S. Pat. No. 5,664,902 which issued to the assignee of the present invention, it is common to purchase seamless steel tubing and cut the tubing into sections. The opposite end portions of the tubing sections may be formed with internal threads, for example, as disclosed in U.S. Pat. No. 3,415,552, or the opposite end portions of a tubing section may be compressed or swaged radially inwardly onto the corresponding opposing end portions of the reinforcing bars, for example, as disclosed in U.S. Pat. No. 3,551,999. While the steel tubing usually has a generally cylindrical inner and outer surfaces, the inner surface may be machined with internal threads or with internal axially spaced circumferential teeth, as shown in the aforementioned patents. The cylindrical tubing may also be formed between dies to produce a tubular coupling body having non-cylindrical outer and/or inner surfaces, for example, as disclosed in above mentioned U.S. Pat. No. 5,664,902.

Since the cost of producing seamless steel tubing is substantially more than the cost of producing solid steel cylindrical bars or rods, tubular rebar coupler bodies have also been produced by machining sections of solid steel bar stock, preferably on a computer controlled lathe or machining center. A bore is first drilled within each solid rod section and then internal threads are machined within the bore. It is also known to machine one end portion of a solid coupler body to form an end portion of reduced diameter and on which external threads are then machined.

The end portion of the coupler body having the drilled bore is secured to an end portion of a concrete reinforcing bar by compressing or swaging the end portion radially with a mechanical or hydraulic press so that the coupler body positively grips the concrete reinforcing bar and provides the bar with an externally threaded end portion. The machined external and internal threads may be generally cylindrical or tapered, depending on the application of the rebar coupler. The primary disadvantage of machining solid steel bar stock or rod is the production of waste or scrap material which adds significantly to the cost of producing the rebar couplers.

SUMMARY OF THE INVENTION

The present invention is directed to an improved method of producing or making steel couplers for joining opposing end portions of concrete reinforcing bars or rebars and which significantly reduces the cost of producing couplers with tubular end portions. In accordance with the invention, a section of solid steel rod is placed within the cavity of a first die member with an end surface of the rod section facing or opposing a bottom end surface of the cavity. A male die or punch is forced axially downwardly or into the solid rod section to form or cold-forge a bore within an end portion of the rod section and to extrude the steel axially in a reverse direction to form a first tubular end portion of a coupler body.

In order to form an internally threaded bore within an opposite end portion of the coupler body, the rod section with a bore in one end portion is placed within another die member defining a second cavity with an inwardly or upwardly projecting punch. The punch projecting downwardly from the moveable die is forced into the bore to cold-forge or extrude the steel into the annular cavity surrounding the bottom die punch and to form a second bore and again to cause a reverse flow of the steel to extend the length of the first bore and the first tubular portion of the coupler body. After the coupler body is removed from the second die member, the bore within the second end portion is internally threaded.

A tubular coupler body having a tubular end portion and a reduced opposite end portion with external threads is formed by inserting a solid rod section into a die cavity having a reduced inner end portion. When the punch on the moveable die is forced axially into the solid rod section to form the first bore and tubular body end portion, the steel extrudes partially into the smaller portion of the cavity. A second step of the cold forging operation completes the reduced diameter solid end portion which is externally threaded.

A coupler body having opposite tubular end portions with an internal radial wall is also formed in accordance with the invention by inserting a solid rod section into a cylindrical cavity of a first die member and forcing a punch with a ram of a hydraulic press into the solid rod section to form partially a first tubular end portion defining a bore. The rod section is then inverted and placed within a cavity of a second die member having a punch projecting inwardly into the first bore. The ram punch is then forced into the solid end portion of the rod section to form or cold-forge the second tubular end portion of the coupler body and to define an integral center wall separating the bores within the opposite end portions of the coupler body. After opposing end portions of two concrete reinforcing bars or rebars are inserted into the bores of the coupler body, the opposite tubular end portions of the body are compressed or swaged inwardly to form positive connections with the rebars.

Other features and advantages of the invention will be apparent from the following description, the accompanying drawings and the appended claims.

DESCRIPTION OF THE PREFERRED EMBODIMENTS

Figure 1:
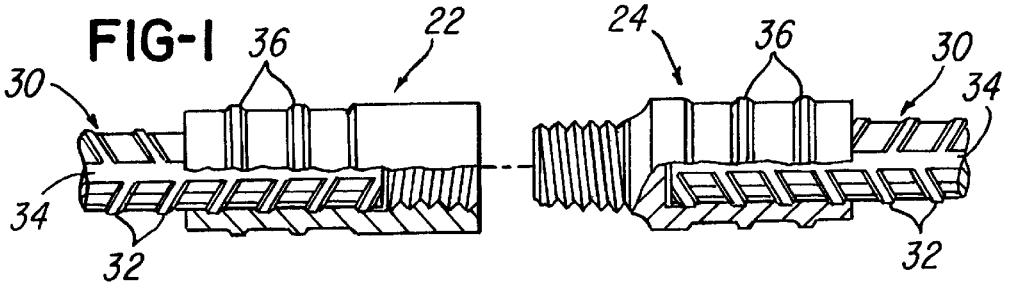
FIG. 1 is a side elevational view of male and female rebar couplers constructed in accordance with the invention and with portions broken away to show attachment to corresponding rebar end portions.

A steel female coupler 22 (FIG. 1) and a steel male coupler 24 are each made or produced in accordance with the present invention for rigidly connecting or coupling the opposing end portions of two concrete reinforcing bars 30, commonly referred to as rebars. Commonly, each of the rebars 30 has longitudinally spaced and circumferentially extending ribs 32 and also a pair of longitudinally extending and diametrically opposite ribs 34 which intersect the ribs 32. As shown in FIG. 1, the steel couplers 22 and 24 are compressed or swaged radially inwardly by dies on a conventional swaging press (not shown) so that each coupler is positively secured to the corresponding reinforcing bar 30. The compressing or swaging operation of each coupler results in producing axially spaced circumferential ribs 36 which cooperate with the ribs 32 and 34 to lock the couplers and rebars to the surrounding concrete.

Figure 2:
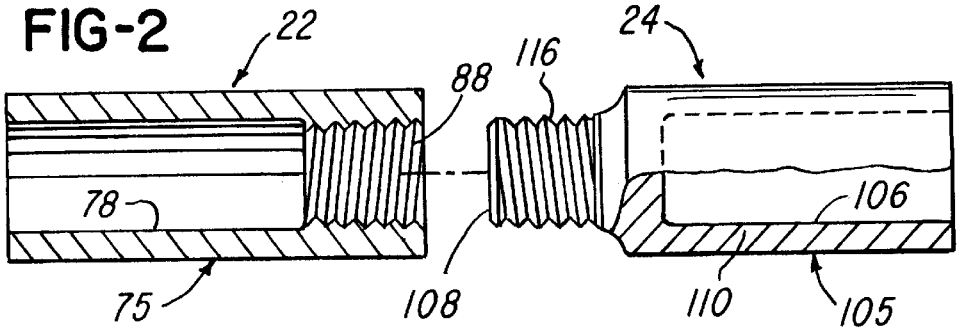
FIG. 2 is a part section view of the couplers shown in FIG. 1 before attachment to the rebar end portions.
Figure 3:
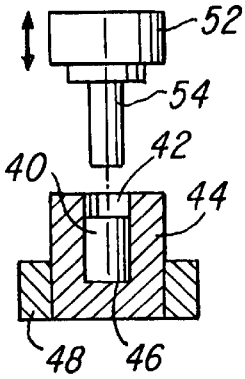
FIGS. 3–6 illustrate diagrammatically the cold-forging steps for making the female coupler body shown in FIG. 2.

FIG. 2 shows each of the steel couplers 22 and 24 before receiving and being swaged onto the end portions of the rebars 30. In accordance with the present invention, the coupler 22 is produced from a cylindrical section 40 (FIG. 3) of a solid steel rod, preferably Grade 1018, but other steel Grades may be used, depending upon the mechanical properties required from the couplers. As diagrammatically illustrated, the steel rod section 40 is inserted into a cylindrical cavity 42 of a cylindrical steel die member 44 with the bottom end of the rod section 40 facing or seated on an end surface 46 of the cavity 42. A retaining ring or plate 48 tightly surrounds the die member 44 for reinforcement. The die member 44 and plate 48 are secured to the bed of a cold-forging press (not shown) which has a vertical moveable ram to which is attached a tooling or die member 52 supporting a cylindrical die or punch 54.

Figure 4:
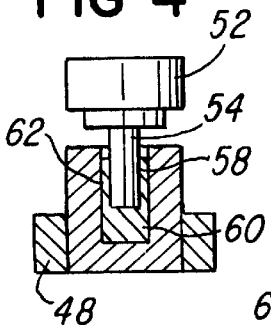
Figure 5:
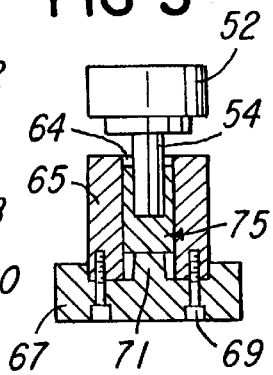

As shown in FIG. 4, the punch 54 is pressed downwardly into the cylindrical solid rod section 40 to cold-forge or form a bore 58 within a partially formed coupler body 60. During the forming of the bore 58, the steel is extruded axially in a reverse flow direction within the cavity 42 around the punch 54 to form a tubular portion 62. Prior to inserting the cylindrical rod section 40 into the cavity 42, the rod section is heat treated for about two hours at about 750° C. and is then slowly cooled to a temperature of about 500° C. over a period of about eight hours. After the rod section returns to room temperature, it is treated with a phosphate solution which is rinsed with water, and the rod section is allowed to air dry.

After partially forming the coupler body 60 by the cold-forging operation shown in FIG. 4, the coupler body is again heat treated and treated with a phosphate solution, as described above, and is then placed within a cylindrical cavity 64 of another cylindrical die member 65. The die member 65 is retained within a counterbore of a base plate 67 by a set of screws 69, and a generally cylindrical protrusion or slightly tapered punch 71 is formed as a part of the base plate 67 and projects upwardly within the counterbore and into the cavity 64.

Figure 6:
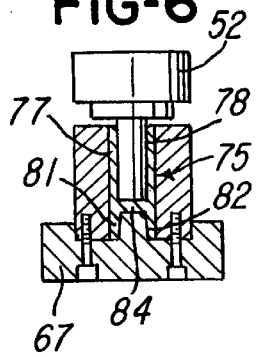
Figure 7:
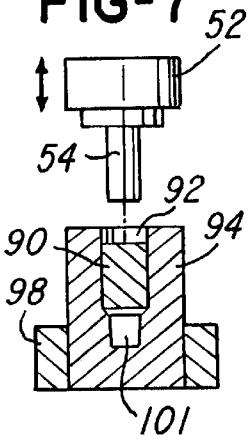
FIGS. 7–10 illustrate diagrammatically the cold-forging steps for making the male coupler body shown in FIG. 2.

During the cold-forging step shown in FIG. 6, the punch 54 is pressed downwardly within the cavity 64 to produce forward or downward extrusion of the steel into the annular cavity surrounding the punch 71 and reverse or upward extrusion within the cavity 64 around the punch 54 to form a coupler body 75 with an upper tubular end portion 77 defining a cylindrical bore 78. The coupler body 75 also has an opposite tubular end portion 81 defining a slightly tapered bore 82, and the bores 78 and 82 are separated by an internal integral radial wall 84. After the coupler body 75 is removed from the die member 65, it is machined to remove the internal wall 84 and to form internal threads 88 to complete the female coupler 22 shown in FIG. 2.

FIGS. 7–10 illustrate the steps for cold-forging a cylindrical solid steel rod section 90 to produce the male coupler body 24 shown in FIG. 2. The rod section 90 is preferably of the same material as the rod section 40 and is preferably 3% to 7% greater in length. After the rod section 90 is heat treated and treated with a phosphate solution in the same manner as described above for the rod section 40, the rod section 90 is inserted into a cavity 92 of a lower die member 94 confined within a bore of a base ring or plate 98. The cavity 92 includes an extension 101 which is slightly tapered.

Figure 8:
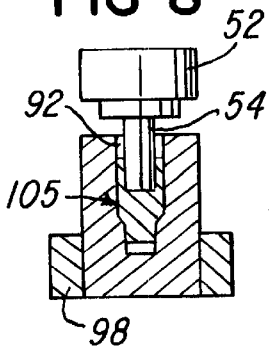
Figure 9:
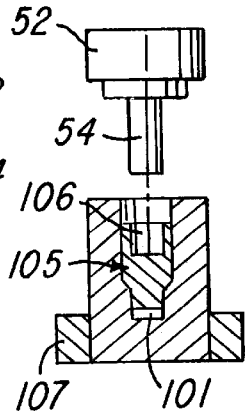
Figure 10:
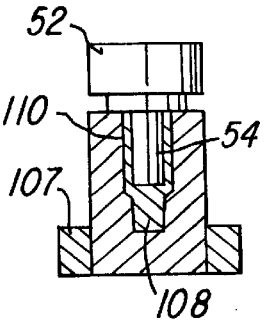

During the first cold-forging step or operation, the punch 54 is forced by the upper die member 52 into the solid rod section 90 causing forward or downward extrusion of the steel partially into the cavity extension 101 and reverse or upward extrusion of the steel into the cavity 92 surrounding the punch 54, as shown in FIG. 8, to form a partially forged preform or coupler body 105. The partially forged preform or coupler body 105 is again processed through the heat treatment and phosphate operations, as described above, and is returned to another die cavity 92 within a die member 94 confined within a base plate 107. The punch 54 is again pressed into a partially formed bore 106 to cause forward extrusion of the partially formed coupler body 105 into the cavity extension 101 of the die member 94 to form a solid end portion 106. The punch also causes reverse or upward extrusion of the steel into the annular portion of the cavity 92 surrounding the punch 54 to form the tubular end portion 110 of the coupler body 105. External threads 116 are rolled or cut onto the solid end portion 108 to form the male coupler 24 shown in FIG. 2.

Figure 11:
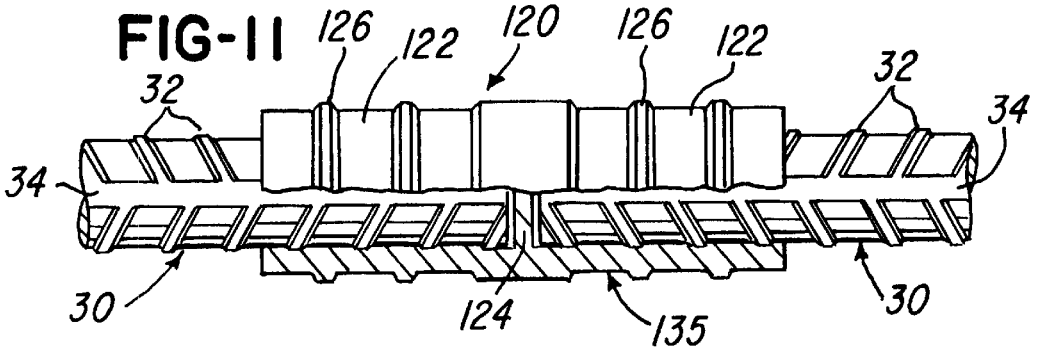
FIG. 11 is an elevational view, in part section, of a tubular rebar coupler also constructed in accordance with the invention and attached to opposing rebar end portions.
Figure 12:
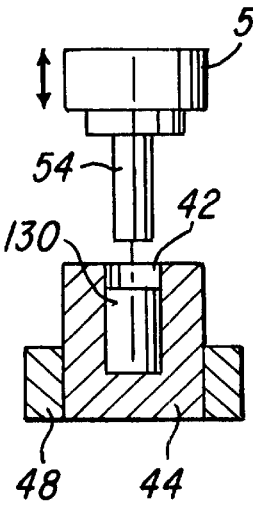
FIGS. 12–15 illustrate the cold-forging steps for making a tubular coupler body as shown in FIG. 16 and used to make the coupler shown in FIG. 11.

Referring to FIG. 11, the cold-forging method of producing a rebar coupler in accordance with the invention, is also used to form a coupler 120 having opposite unthreaded tubular end portions 122 separated by an integrally forged intermediate radial wall 124. The tubular end portions 122 receive corresponding opposing end portions of two concrete reinforcing bars or rebars 30, and the tubular end portions 122 are compressed or swaged radially inwardly into the rebars 30 and between the ribs 32 and 34 to form positive high strength connections with the rebars 30. The conventional swaging operation is performed by mating dies (not shown) which are usually operated by a portable hydraulic press and which produced circumferential ribs 126 such as the ribs 36 described above in connection with FIG. 1.

Figure 13:
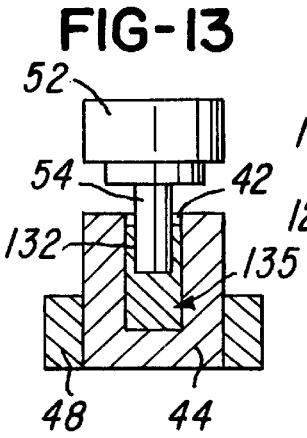
Figure 14:
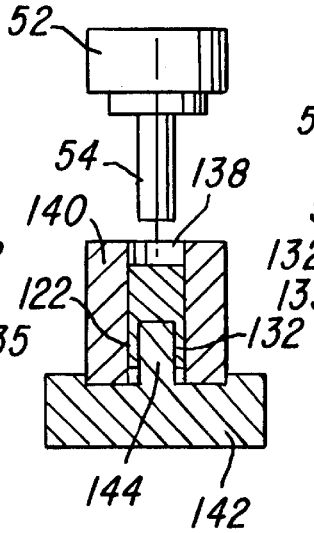
Figure 15:
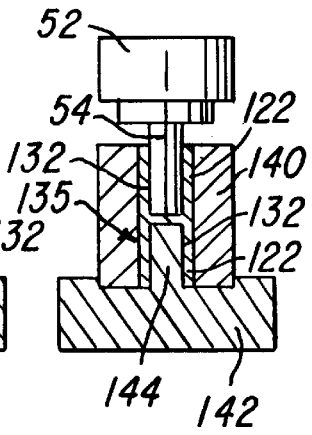
Figure 16:
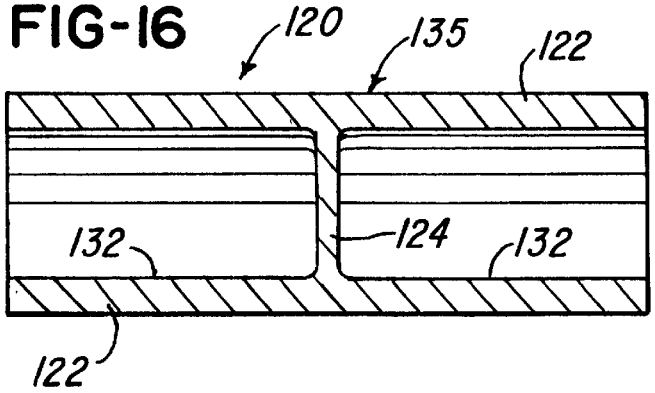
FIG. 16 is an axial section of the tubular coupler body produced by the method steps shown in FIGS. 12–15.

FIG. 16 shows the body of the coupler 120 before receiving the end portions of the rebars 30 and before the swaging operations and is also produced by steps which include the cold-forging a cylindrical solid steel rod section 130 (FIGS. 12–15). The rod section 130 is first processed through the heat treatment and phosphate operations described above in connection with the solid rod sections 40 and 90. The rod section 130 is then placed within the cylindrical cavity 42 of the lower die member 44, and the punch 54, supported by the ram of the forging press, is forced downwardly into the rod section as shown in FIG. 13 for partially forming a bore 132 and partially forming one of the tubular end portions 122 of a partially formed coupler body 135.

After the coupler body 135 is removed from the cavity 42, it is again processed through the heat treatment and phosphate operations, and is then inserted into a cavity 138 of a lower cylindrical die member 140. The lower die member 140 includes a base plate 142 having a protrusion or punch 144 projecting upwardly into the cavity 138. During the next cold-forging step or operation (FIG. 15) the punch 54 is forced into the solid upper end portion of the partially formed coupler body 135 to form the tubular opposite end portions 122 of the coupler 120 by forward flow or extrusion of the steel downwardly around the punch 144 and reverse flow or extrusion of the steel upwardly within the cavity 138 around the punch 54. The completely forged coupler body 135 shown in FIG. 15, is removed from the die cavity 138 and is shown in section in FIG. 16.

From the drawings and the above description, it is apparent that a rebar coupler constructed in accordance with the method of the present invention, provides desirable advantages. As a primary advantage, by processing a solid cylindrical section of steel rod using the steps described above, a rebar coupler is made or produced at a substantially lower cost for each coupler since the cost of solid steel rods is significantly lower than the cost of seamless steel tubing. The cold-forging operations or steps also produce a coupler with precision and uniform wall thickness which is desirable for the swaging operations. As illustrated, the method of the invention may be used to form rebar coupler bodies having threaded end portions as described in connection with FIGS. 1–10 or non-threaded coupler bodies, as described in connection with FIGS. 11–16.

While the rebar couplers and the method of producing the couplers herein described constitute preferred embodiments of the invention, it is to be understood that the invention is not limited to the precise coupler, method and form of forging apparatus described, and that changes may be made therein without departing from the scope and spirit of the invention as defined in the appended claims.

What is claimed is:

1. A method of making a rebar coupler and for rigidly connecting the coupler to an end portion of a concrete reinforcing bar, comprising the steps of forming a cavity in a first die member with an inner extension portion of the cavity smaller than an outer portion of the cavity and having a tapered inner surface, inserting a solid steel rod section into the cavity of the first die member with an end surface of the steel rod section opposing an inner end surface of the inner extension portion of the die cavity, forcing a punch along an axis of the cavity into a solid first end portion of the solid rod section to forge a first bore and a tubular first end portion of a coupler body and to forge a second solid end portion of the solid rod section into the inner extension portion of the cavity to form a solid second end portion of the coupler body smaller than the tubular first end portion of the coupler body and having a tapered outer surface, forming external threads on the tapered outer surface of the second end portion of the coupler body, extending the end portion of the concrete reinforcing bar into the tubular first end portion of the coupler body, and compressing the first end portion of the coupler body radially inwardly against the end portion of the concrete reinforcing bar to form a rigid connection therebetween.

2. The method of claim 1 in combination with a method of making a second rebar coupler and for rigidly connecting the second rebar coupler to an end portion of a second concrete reinforcing bar, comprising the steps of forming a second cavity in a second die member having a second punch projecting into an end portion of the second cavity, inserting a second solid steel rod section into the second cavity of the second die member, forcing a third punch along an axis of the second cavity into a solid first end portion of the second solid rod section to forge a second bore and a third bore within opposite end portions of the second solid rod section and to form a second coupler body, forming internal threads within the second bore of the second coupler body, extending the end portion of the second concrete reinforcing bar into the third bore of the second coupler body, and compressing an end portion of the second coupler body defining the third bore radially inwardly against the end portion of the second concrete reinforcing bar to form a rigid connection therebetween.

* * * * *